US006802583B2

(12) United States Patent
Tamura

(10) Patent No.: US 6,802,583 B2
(45) Date of Patent: Oct. 12, 2004

(54) INK JET PRINT HEAD AND INK JET PRINTING APPARATUS

(75) Inventor: Yasuyuki Tamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/817,040

(22) Filed: Mar. 27, 2001

(65) Prior Publication Data

US 2001/0033305 A1 Oct. 25, 2001

(30) Foreign Application Priority Data

Mar. 28, 2000 (JP) ..... 2000-089652

(51) Int. Cl.[7] ..... B41J 29/38
(52) U.S. Cl. ..... 347/14
(58) Field of Search ..... 347/9, 14, 19

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 5,083,137 | A | * | 1/1992 | Badyal et al. | 347/9 |
| 5,220,357 | A | * | 6/1993 | Kubo et al. | 347/112 |
| 5,300,968 | A | | 4/1994 | Hawkins | 347/12 |
| 5,446,475 | A | * | 8/1995 | Patry | 347/191 |
| 5,497,174 | A | | 3/1996 | Stephany et al. | 347/13 |
| 5,521,620 | A | * | 5/1996 | Becerra et al. | 347/14 |
| 5,751,302 | A | * | 5/1998 | Rezanka | 347/9 |
| 5,767,872 | A | * | 6/1998 | Scardovi et al. | 347/17 |
| 6,183,056 | B1 | * | 2/2001 | Corrigan et al. | 347/14 |

FOREIGN PATENT DOCUMENTS

| | | |
|---|---|---|
| EP | 0 913 255 | 5/1999 |
| JP | 54-56847 | 5/1979 |
| JP | 59-123670 | 7/1984 |
| JP | 59-138461 | 8/1984 |
| JP | 60-71260 | 4/1985 |
| JP | 2-95645 | 7/1990 |
| JP | 10-181017 | 7/1998 |
| JP | 11-192702 | 7/1999 |

* cited by examiner

*Primary Examiner*—Lamson Nguyen
*Assistant Examiner*—Blaise Mouttet
(74) *Attorney, Agent, or Firm*—Fitzparrick, Cella, Harper & Scinto

(57) ABSTRACT

The ink jet print head according to this invention includes a plurality of nozzles; a plurality of electrothermal transducers with one transducer provided for each of the plurality of nozzles, the electrothermal transducers being adapted to eject ink supplied into the nozzles when energized; an energization start circuit to start energizing the electrothermal transducers; a voltage detection circuit to detect a voltage applied to the electrothermal transducers after starting the energization; and an energization stop circuit to stop the energization of the electrothermal transducers according to the voltage detected by the voltage detection circuit.

16 Claims, 5 Drawing Sheets

INK JET PRINT HEAD AND INK JET PRINTING APPARATUS

This application is based on Patent Application No. 2000-89652 filed Mar. 28, 2000 in Japan, the content of which is incorporated hereinto by reference.

BACKGROUND OF THE INVENTION

1. Field of the Invention

The present invention relates to an ink jet print head, an ink jet printing apparatus having the ink jet print head, and an ink jet printing method, and more specifically to a control for driving an energy generation element provided in each of a plurality of ink ejection nozzles in the ink jet print head.

2. Description of the Related Art

An on-demand type ink jet printing system is showing a rapid growth in recent years. A so-called bubble jet printing system in particular has found a wide range of applications because of its advantages, such as a simple structure of the print head and its capability of having a large number of nozzles arranged in high density. The print head using this bubble jet printing system employs a heater as the energy generation element for ejecting ink, which heats ink to generate a bubble and eject ink by the bubble energy.

In performing high-speed printing by using such a bubble jet printing system, it is effective to increase the number of nozzles. Driving many nozzles at the same time, however, causes a large power to be supplied to these nozzles instantaneously, giving rise to a possibility of a power supply voltage drop. Hence, to reliably operate a large number of nozzles, a power supply with a large capacity is required. In the bubble jet printing system, a bubble is generated in the ink by an electric power pulse of a very short duration as small as a few microseconds. Thus, when a large number of nozzles are driven at the same time, a large current flows at the instant of nozzle operation, causing a significant drop in the supply voltage. This results in a shortage of energy for nozzle operation, rendering the ink ejection from the nozzles unstable, significantly reducing the quality of a printed image.

To avoid this problem, it has generally been known to divide a large number of nozzles into a plurality of blocks and drive these blocks at different timings in a time-division manner. In this case, too, when an overall number of nozzles in the print head is large and each block is allocated with many nozzles, a significant voltage drop will occur whenever a block is driven. If the number of blocks is increased to reduce the number of nozzles to be operated at the same time, the time taken to drive all the blocks becomes long, making it necessary to reduce a drive frequency, which in turn leads to a reduced operation speed, another serious problem directly involved with the printing performance.

As a common countermeasure to eliminate such a voltage drop in a field other than the printing technology field, a remote sensing system has been known. This system detects a voltage between terminals of each load that consumes electricity, and feeds back the detected voltage to a constant voltage circuit of the power supply to keep the voltage across the load constant and thereby stabilize the operation of the load. However, in an attempt to apply such technology to a bubble jet printing system, the remote sensing system may not work effectively because the drive pulse is very short. That is, for a pulse current of a very short pulse width to be fed back, a high-speed feedback circuit is required. But because the remote sensing circuit has long wiring, the current phase is delayed making the high-speed feedback circuit operation unstable, causing an oscillation problem.

To solve this problem, Japanese Patent Application Laid-open No. 10-181017 (1998) previously filed by the applicant of this invention describes a drive method which counts the number of nozzles to be driven at the same time and determines a pulse width of a voltage pulse based on the count value. Because this drive method estimates a voltage drop of voltage applied to the heater of the nozzle and, based on the estimated result, corrects the drive pulse width, it is possible to perform a stable drive without applying an excess voltage. However, in the drive system of Japanese Patent Application Laid-open No. 10-181017 (1998), too, variations in resistance of power wires for the print head and variations in resistance of electrothermal transducers combine to produce errors. Further, if there is a large capacitor in the power wires, the voltage drop can vary widely depending not only on the current consumption at that instant but also on the immediately preceding current consumption, making the correction more difficult. Even with this drive system, it is currently not possible to provide a perfect correction.

As described above, in the conventional ink jet printing apparatus, the presence of power supply voltage variations normally makes it necessary to set the pulse width large enough to be able to supply a sufficient power for driving nozzles even when there is a supply voltage drop. The large pulse width in turn produces various problems, including increased power consumptions, large temperature rises in the print head, a shorter longevity of the print head, and burnt deposits on the heater degrading the ejection performance and the quality of printed images.

SUMMARY OF THE INVENTION

An object of the present invention is to provide an ink jet print head capable of stably and reliably driving an energy generation means such as heater at all times and also an ink jet printing apparatus having the same and an ink jet printing method.

In a first aspect of the present invention, there is provided an ink jet print head comprising:

- a plurality of nozzles each having an electrothermal transducer to eject ink supplied into the nozzles when energized;
- energization start means for start energizing the electrothermal transducers;
- voltage detection means for detecting a voltage applied after starting the energization to the electrothermal transducers; and
- energization stop means for stopping the energization of the electrothermal transducers according to the voltage detected by the voltage detection means.

In a second aspect of the present invention, there is provided an ink jet printing apparatus having an ink jet print head, the ink jet print head being adapted to print on a predetermined print medium by ejecting ink from a plurality of nozzles, the ink jet print head comprising:

- a plurality of nozzles each having an electrothermal transducer to eject ink supplied into the nozzles when energized;
- energization start means for starting energizing the electrothermal transducers;
- voltage detection means for detecting a voltage applied after starting the energization to the electrothermal transducers; and
- energization stopping means for stopping the energization of the electrothermal transducers according to the voltage detected by the voltage detection means.

In a third aspect of the present invention, there is provided an ink jet printing method for performing printing by ejecting ink, comprising the steps of:

starting energizing electrothermal transducers which generate thermal energy for ejecting ink;

detecting a voltage applied after the start of the energization to the electrothermal transducers; and stopping the energization of the electrothermal transducers according to the voltage detected.

In the present invention with the construction described above, the time during which the energy generation means is energized is determined according to the actual voltage applied to the ink jet print head. That is, when the voltage applied to the electrothermal transducer is large, the time from the start to the end of the energization is set short. When the voltage applied to the electrothermal transducer is small, the time from the start to the end of the energization is set long. This enables an appropriate power to be supplied to the electrothermal transducer at all times, realizing a stable ejection of ink.

Further, in this invention, because the detected applied voltage is not fed back to the power supply, the apparatus can be constructed of a drive circuit with a smaller time constant than when a feedback circuit is additionally formed, thus eliminating such problems as oscillations during operation.

The above and other objects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described by referring to the accompanying drawings.

(First Embodiment)

FIG. 1 to FIG. 4 represent the first embodiment of the invention.

Figure 1:
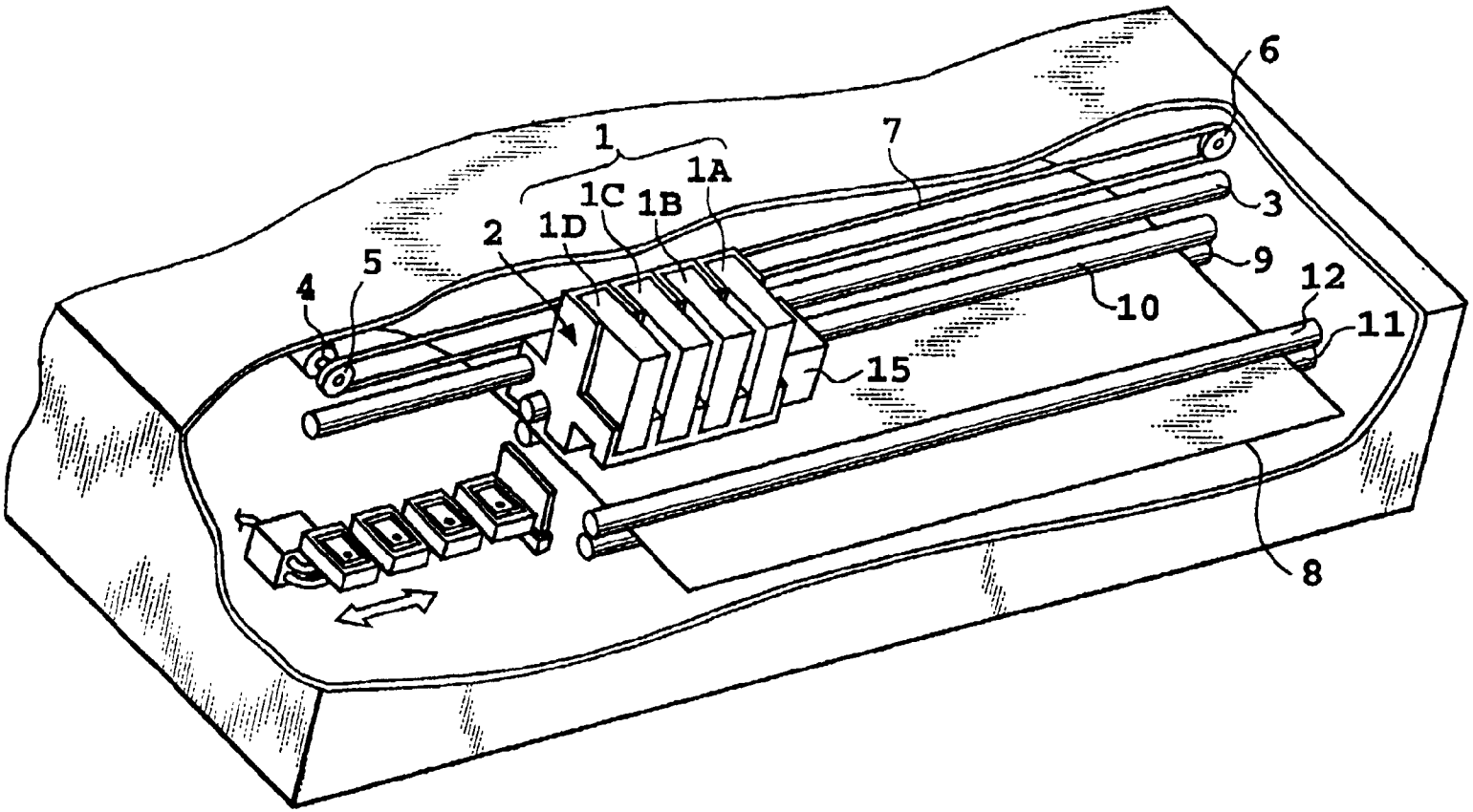
FIG. 1 is a perspective view schematically showing the construction of an ink jet printing apparatus as a first embodiment of the invention.

In FIG. 1, a print unit that prints on a print medium has plural (in this example, four) head cartridges 1A, 1B, 1C, 1D and a carriage 2 that replaceably mounts these head cartridges. The head cartridges 1A to 1D each have an ink jet print head 13 (see FIG. 2) and an ink tank. The print head 13 has a connector for receiving a drive signal. In the explanation that follows, when we refer to all the head cartridges 1A to 1D or any one head cartridge, they are represented simply as a head cartridge 1.

The plurality of head cartridges 1 use inks of different colors for printing. The ink tanks 1A–1D mounted in the individual head cartridges 1 contain different color inks, such as black, cyan, magenta and yellow. The head cartridges 1 are each replaceably mounted on the carriage 2 at their predetermined positions. The carriage 2 has a connector holder (electric interface portion) for transferring drive signals to the head cartridges 1 through the connectors.

The carriage 2 is movably supported on a guide shaft 3 that extends in a main scan direction in the apparatus body, so that it can be moved back and forth in the main scan direction. The carriage 2 is reciprocated by a main scan motor 4 through a drive mechanism including a motor pulley 5, a follower pulley 6 and a timing belt 7. The position and the movement of the carriage 2 is controlled by a control system described later.

A print medium 8, such as print paper and plastic thin film, is fed by the rotation of two pairs of transport rollers 9, 10 and 11, 12 to pass through a position (print area) facing a nozzle face 21 (see FIG. 2) of the head cartridges 1. The print medium 8 has its back supported on a platen (not shown) so that it forms a planar recording surface in the print area. The nozzle face 21 of each of the head cartridges 1 mounted on the carriage 2 protrudes downwardly from the carriage 2 and is held parallel to the print medium 8 clamped between the two pairs of the transport rollers. Further, the carriage 2 has a reflection type optical sensor 15 as a density sensor.

The head cartridges 1 are ink jet head cartridges designed to eject ink from a plurality of nozzles by using thermal energy and have electrothermal transducers (heaters) corresponding to nozzles. That is, the recording portions of the head cartridges 1 convert electric energy into thermal energy by the heaters installed in the individual nozzles and causes film boiling in the ink by the thermal energy to produce bubbles whose energy is used to eject ink from the ejection ports.

Figure 2:
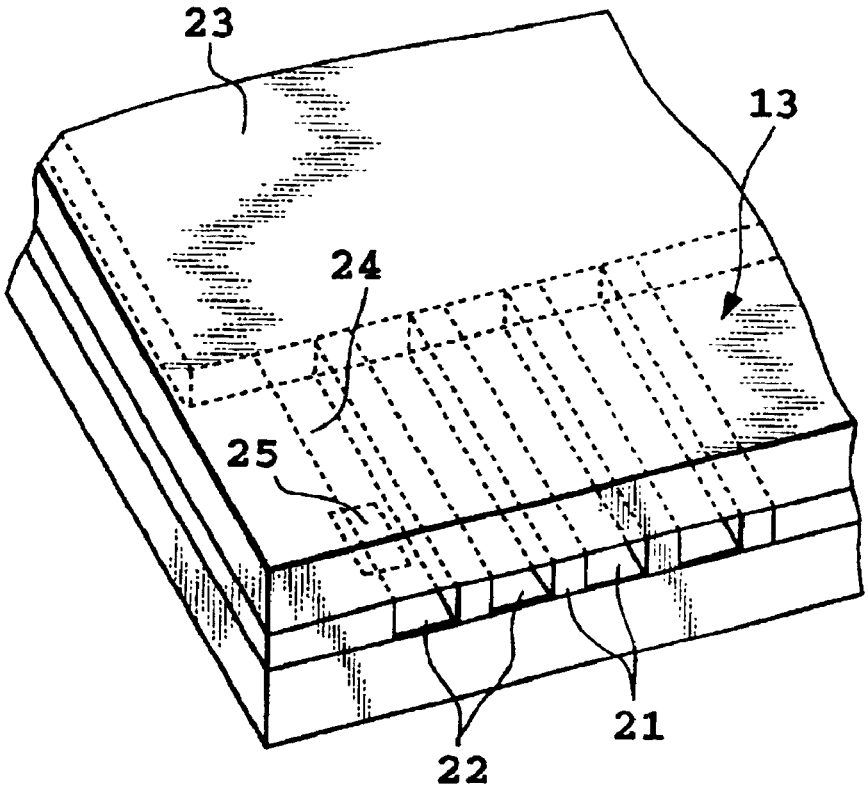
FIG. 2 is a perspective view schematically showing the structures of ejection ports and heaters in the ink jet print head applied to the first embodiment.

FIG. 2 is a perspective view schematically showing a part of the ink jet print head 13 in the head cartridge 1.

The nozzle face 21 that faces the print medium 8 supported in the print area as described above with a predetermined gap (for example, about 0.5–2 mm) therebetween is formed with a plurality of ejection ports 22 at a predetermined pitch. The ejection ports 22 are each communicated with a common liquid chamber 23 through liquid paths 24. Heaters 25 for generating thermal energy for ink ejection are arranged along the wall surfaces of the individual liquid paths 24. The wall surface of each liquid path 24 is formed by one surface of a substrate of, say, silicon. The liquid paths 24 and the ejection ports 22 located at their ends together form a plurality of nozzles.

Here, the mounting direction of the ink tanks 1A–1D mounted on the carriage 2 and the arrangement direction of the ejection ports 22 in the head cartridge 1 are set to cross the scan direction of the carriage 2.

In the ink jet head constructed as described above, when a drive current representing an image signal or ejection signal is applied to the heater 25, the energized heater 25 causes film boiling in the ink present in the liquid path 24, thus ejecting ink from the ejection port 22 by the pressure of the film boiling.

Figure 3:
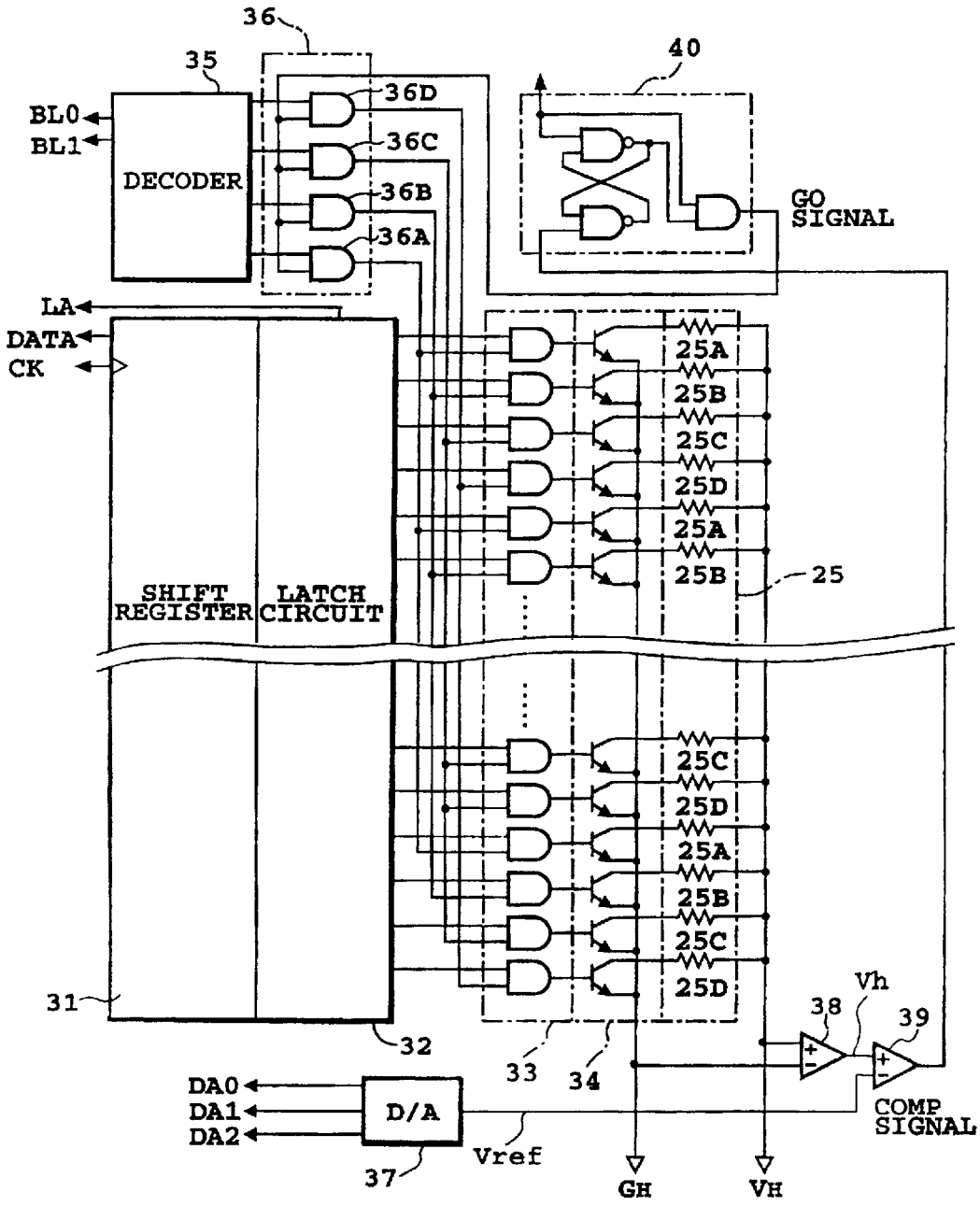
FIG. 3 is a diagram of a drive circuit for the ink jet print head applied to the first embodiment.

FIG. 3 shows an example of a drive circuit for the ink jet print head 13 in the first embodiment.

Data for driving the heaters 25 in the individual nozzles of the ink jet print head 13 are sent through a data line DATA to a serial shift register 31, from which it is latched by a latch circuit 32 before being supplied to a gate array 33. The gate array 33 outputs signals in response to the drive data received to turn on a transistor array 34, thus supplying current from the power supply to the heaters 25. In this embodiment, a large number of heaters 25 are divided into four blocks 25A–25D, which are individually driven. Operating the heaters one block at a time reduces the amount of current that flows instantaneously. BL0 and BL1 represent control signals for this operation. These control signals are fed through a decoder 35 to gate circuits 36A–36D for block operation. The gate circuits 36A–36D drive the heaters 25 in the associated block according to a GO signal received. The time during which the heaters 25 are energized is determined by an energization start signal (GO signal) generated in an energization start signal generation circuit (energization start means) 40 of FIG. 1.

Figure 4:
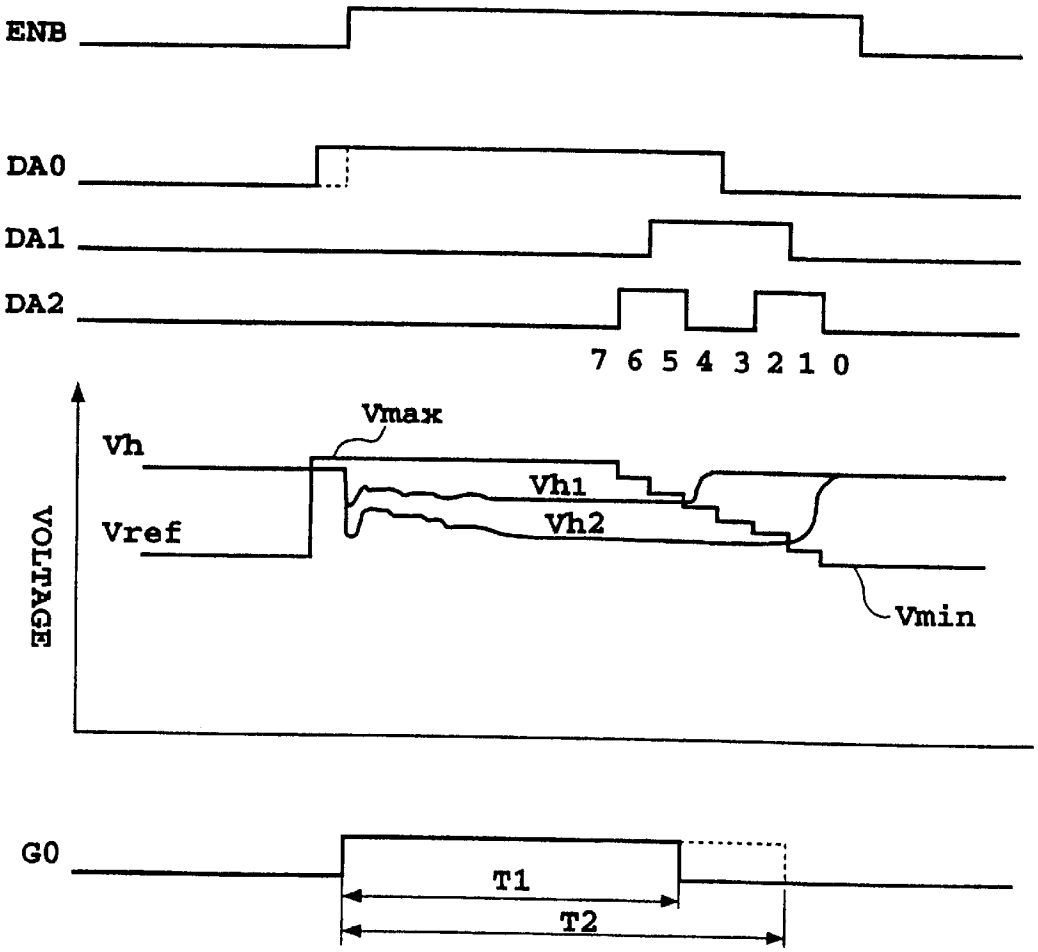
FIG. 4 is a timing chart showing operations of parts of the circuit of FIG. 3.

FIG. 4 is a timing chart showing signals at associated parts of the circuit in FIG. 3.

As shown in the figure, when the GO signal goes high at the leading edge of an ENB signal, the power begins to be applied to the heaters 25. At this time, a D/A converter 37 is supplied with 3-bit data DA0, DA1, DA2 which are successively changed after the ENB signal goes high. As a result, the output of the D/A converter 37 progressively decreases from a maximum value Vmax, which is higher than the maximum value of a voltage Vh applied to the heaters 25, down to a minimum value Vmin, which is lower than the minimum value of the applied voltage Vh.

The output of the D/A converter 37 is compared by a comparator (energization stop means) 39 with an output of a differential amplifier (voltage detection means) 38 that detects the voltage Vh of the power line used to drive the heaters 25. Then, when the output signal (Vref signal) of the D/A converter 37 becomes lower than the output Vh of the differential amplifier 38, the comparator 39 outputs an energization stop signal (COMP signal) to the energization start signal generation circuit 40. Upon receiving the energization stop signal, the circuit 40 turns off the GO signal, the energization start signal, which it was outputting. As a result, a gate circuit 36 produces low-level outputs (L signals) and the gate array 33 that has received these L signals also outputs L signals, turning off the transistor array 34. Hence, the heaters 25 are deenergized.

Thus, by determining the timing at which the 3-bit data DA0, DA1, DA2 input to the D/A converter are changed, the duration in which the heaters 25 are kept energized can be determined according the value of the applied voltage Vh.

Consider a case where the voltage Vh applied to the heaters 25 is relatively high, as at Vh1 in FIG. 4. The voltage value Vh1 becomes equal to Vref before the output value Vref of the D/A converter 37 decreases significantly, i.e., before a significant length of time elapses. Before that point, the voltage value Vh1 is less than the output value Vref. Hence, the pulse width T1 of the GO signal is relatively narrow. In a case where the applied voltage is relatively low, as at Vh2, the voltage value Vh2 agrees with Vref after the output Vref of the D/A converter 37 has decreased significantly, i.e., a relatively long period has elapsed. Before that point, the voltage value Vh2 is less than the output value Vref. Hence, the pulse width T2 of the GO signal is relatively large. As a result, the heaters 25 can be supplied with a sufficient power even when the applied voltage Vh falls. The timing at which the data is output from the D/A converter 37 should preferably be set by considering not only design values characteristic of the head but also manufacturing variations, head temperature and the like.

The ENB signal is turned off so as to provide a duration in which the heaters 25 should be kept energized when the applied voltage is the lowest. This prevents the heaters 25 from being energized over an abnormally long period, thus improving the safety of the apparatus even when there are abnormal voltage variations.

Further, in this embodiment, the 3-bit data DA0, DA1, DA2 are supplied, not in the normal binary code, but in the Gray binary code. This ensures that whenever there is a change in the data, only one bit is allowed to change at a time, preventing the data from varying significantly when a slight deviation in transmission timing occurs. Thus, erroneous operations will not result.

Further, the circuit shown in FIG. 3 may be provided all within the ink jet print head. Or a part of the circuit may be provided in the ink jet print head with the remaining installed in other than the print head within the ink jet printing apparatus.

When the entire or part of the circuit is installed in the ink jet print head, it may be integrally incorporated into the substrate that forms the ink jet print head, by using the semiconductor circuit chip fabrication process or the like.

(Second Embodiment)

Next, the second embodiment of the ink jet printing apparatus according to this invention will be described.

Figure 5:
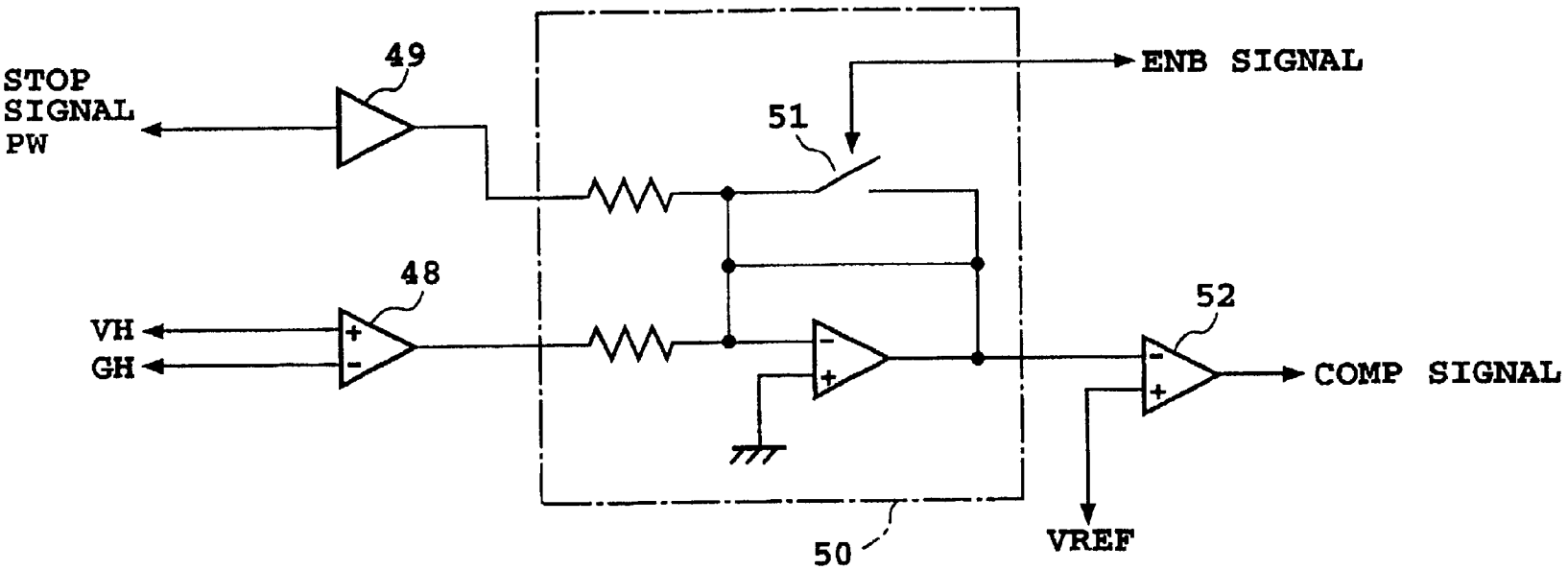
FIG. 5 is a circuit diagram showing an essential part of a drive circuit for the ink jet print head in a second embodiment of the invention.

In the second embodiment, the energization stop signal (COMP signal) generation circuit is formed of a circuit shown in FIG. 5, instead of the differential amplifier 38 and the D/A converter 37 in FIG. 3. In other respects, the configuration is similar to that shown in FIG. 3.

In the circuit shown in FIG. 5, an output of a differential amplifier 48 that detects a voltage of the heater energizing power line and a DC voltage signal (PW signal) that is fed through a buffer amplifier 49 are added up and integrated by an integration circuit 50. When the integrated result reaches a predetermined value VREF, the COMP signal as the energization stop signal is output from a comparator 52, causing the GO signal as the energization start signal to go low, thus stopping the supply of power to the heaters 25. The integration circuit 50 and the comparator 52 form an energization stop means. In the integration circuit 50, when the ENB signal is low, a switch 51 in the figure is closed to reset the integration circuit 50. When the ENB signal is high, the switch 51 is open, restarting the integration.

The value of the PW signal should preferably be set according to the temperature of the ink jet print head. Because the PW signal is not a signal that changes at high speed, there is no need to consider a timing problem.

In the second embodiment, too, as in the first embodiment, the entire circuit shown in FIG. 5 may be provided in the ink jet print head. Alternatively a part of the circuit of FIG. 5 may be installed in the print head with the remaining installed in other than the print head within the ink jet printing apparatus.

Further in the second embodiment because the number of contacts with external circuits outside the head can be reduced, compared with the first embodiment, improvements can be made to the ease of manufacture, durability and reliability. Further, the integration of voltage provides immunity from being affected by rapid voltage variations due to noise and the advantage of being able to perform control at an appropriate timing.

In the integration circuit using the analog circuit of FIG. 5, a high precision is required of such elements as capacitors, so that it may be difficult to incorporate these elements into an ordinary IC circuit. However, in incorporating the circuit implementing this embodiment into the print head, if a manufacturing process is taken which involves first forming an amplifier, a logic circuit and heaters in the silicon substrate and then mounting resistors and capacitors of the integration circuit around their peripheries, it is possible to form a highly precise circuit relatively easily and therefore reduce the overall cost of the entire apparatus.

In the above embodiment, as the voltage of the power line for energizing the heaters, a line voltage between positive and negative power lines is detected by the differential amplifier. This may be replaced by the detection of the potential of only one polarity. That is, generally the potentials on the positive side and on the negative side rarely change individually, but in most cases change similarly. Hence, simply measuring only one polarity can detect the voltage variations well, thereby simplifying the circuit.

In energizing the heaters, there are two methods, one that applies a single drive pulse for one ejection and one that applies a plurality of drive pulses for one ejection. This invention is applicable to either type of driving.

Further, in the case of energizing the heaters by applying a plurality of drive pulses, the timings of energizing and de-energizing both pulses may be controlled according to this invention, or only one drive pulse that actually produces a bubble may be used with the invention.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through-holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, regardless of the state prior to the driving of the energy generation elements, this invention determines the width of a drive pulse according to the voltage drop that occurs as the energy generation elements are driven. Hence, the minimum required drive pulse can be supplied without being affected by the stability of the power supply circuit, wiring resistance variations and variations in contact resistance of wires, thus allowing the electrothermal transducers to be driven reliably.

Further, because no feedback circuit is used, there is no problem of possible oscillations even when the drive control of the electrothermal transducers is performed at high speed. This enables a highly stable control, which in turn offers such advantages as preventing excess power from being applied to the energy generation elements, reducing power consumption, preventing excess temperature rises of the electrothermal transducers, allowing for high-speed recording, and significantly extending the longevity of the electrothermal transducers.

Furthermore, this invention can realize a significant reduction in the size of the circuit when compared with the conventional system that counts the number of electrothermal transducers that need to be driven simultaneously.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet print head comprising:

a plurality of nozzles each having an electrothermal transducer to eject ink supplied into the nozzles when energized;

comparison means for comparing a voltage applied to said electrothermal transducers with a reference voltage;

reference voltage changing means for changing the reference voltage; and energization stop means for stopping the energization of said electrothermal transducers according to a comparison result obtained by said comparison means.

2. An ink jet print head according to claim 1, wherein said energization stop means controls an energization duration of said electrothermal transducers according to the voltage applied to said electrothermal transducers, and increases the energization duration as the applied voltage falls.

3. An ink jet print head according to claim 2, wherein said energization stop means comprises stop signal output means for outputting an energization stop signal for stopping the energization of said electrothermal transducers when the voltage applied to said electrothermal transducers during the energization is equal to a predetermined reference voltage, and wherein the reference voltage is reduced over a predetermined time elapse from a predetermined maximum set voltage value, higher than a maximum voltage value of the applied voltage, down to a predetermined minimum set voltage value, lower than a minimum voltage value of the applied voltage.

4. An ink jet print head according to claim 1, wherein said energization stop means comprises a stop signal output means which integrates a sum of the voltage applied to said electrothermal transducers during the energization and a predetermined DC voltage and, when an integrated value reaches a predetermined value, outputs an energization stop signal to stop the energization of said electrothermal transducers.

5. An ink jet print head according to claim 1, wherein said electrothermal transducers generate bubbles in ink by thermal energy and eject ink from said nozzles by energy produced by the bubbles.

6. An ink jet print head according to claim 1, wherein said plurality of nozzles are divided into a plurality of blocks and said electrothermal transducers are driven one block at a time.

7. An ink jet print head according to claim 1, wherein said reference voltage changing means changes the reference voltage so as to lower the reference voltage.

8. An ink jet printing apparatus using an ink jet print head, said ink jet print head being adapted to print on a predetermined print medium by ejecting ink, said ink jet print head comprising:

a plurality of nozzles each having an electrothermal transducer to eject ink supplied into said nozzles when energized;

comparison means for comparing a voltage applied to said electrothermal transducers with a reference voltage;

reference voltage changing means for changing the reference voltage; and energization stop means for stopping the energization of said electrothermal transducers according to a comparison result obtained by said comparison means.

9. An ink jet printing apparatus according to claim 8, wherein said energization stop means controls an energization duration of said electrothermal transducers according to the voltage applied to said electrothermal transducers, and increases the energization duration as the applied voltage falls.

10. An ink jet printing apparatus according to claim 9, wherein said energization stop means comprises stop signal output means for outputting an energization stop signal for stopping the energization of said electrothermal transducers when the voltage applied to said electrothermal transducers during the energization is equal to a predetermined reference voltage, and wherein the reference voltage is reduced over a predetermined time elapse from a predetermined maximum set voltage value, higher than a maximum voltage value of the applied voltage, down to a predetermined minimum set voltage value, lower than a minimum voltage value of the applied voltage.

11. An ink jet printing apparatus according to claim 8, wherein said energization stop means has a stop signal output means which integrates a sum of the voltage applied to said electrothermal transducers during the energization and a predetermined DC voltage and, when an integrated value reaches a predetermined value, outputs an energization stop signal to stop the energization of the electrothermal transducers.

12. An ink jet printing apparatus according to claim 8, wherein said electrothermal transducers generate bubbles in ink by thermal energy and eject ink from said nozzles by energy produced by the bubbles.

13. An ink jet printing apparatus according to claim 8, wherein said plurality of nozzles are divided into a plurality of blocks and said electrothermal transducers are driven one block at a time.

14. An ink jet printing apparatus according to claim 8, wherein said reference voltage changing means changes the reference voltage so as to lower the reference voltage.

15. An ink jet printing method for performing printing by ejecting ink utilizing electrothermal transducers, comprising the steps of:

comparing a voltage applied to the electrothermal transducers with a reference voltage;

changing the reference voltage; and stopping the energization of the electrothermal transducers according to a comparison result obtained in said comparison step.

16. An ink jet printing method according to claim 15, wherein said step of changing the reference voltage changes the reference voltage in a manner lowering the reference voltage.

* * * * *

UNITED STATES PATENT AND TRADEMARK OFFICE

CERTIFICATE OF CORRECTION

PATENT NO. : 6,802,583 B2
DATED : October 12, 2004
INVENTOR(S) : Tamura

It is certified that error appears in the above-identified patent and that said Letters Patent is hereby corrected as shown below:

Title page,
Item [74], *Attorney, Agent, or Firm*, "Fitzparrick, Cella, Harper & Scinto" should read -- Fitzpatrick, Cella, Harper & Scinto --.

Signed and Sealed this

Twenty-sixth Day of July, 2005

JON W. DUDAS
*Director of the United States Patent and Trademark Office*